US008808061B2

(12) United States Patent
Koyama

(10) Patent No.: US 8,808,061 B2
(45) Date of Patent: Aug. 19, 2014

(54) METHOD AND APPARATUS FOR DRESSING POLISHING PAD

(75) Inventor: Harumichi Koyama, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 220 days.

(21) Appl. No.: 13/164,081

(22) Filed: Jun. 20, 2011

(65) Prior Publication Data

US 2011/0312254 A1 Dec. 22, 2011

(30) Foreign Application Priority Data

Jun. 21, 2010 (JP) ..... 2010-140995

(51) Int. Cl.
*B24B 33/00* (2006.01)

(52) U.S. Cl.
USPC ..... 451/56; 451/443; 451/444

(58) Field of Classification Search
USPC ..... 451/41, 56, 285, 287, 443, 444; 125/11.01, 11.02
See application file for complete search history.

(56) References Cited

U.S. PATENT DOCUMENTS

| | | | | |
|---|---|---|---|---|
| 4,984,390 | A * | 1/1991 | Kobayashi | 451/443 |
| 5,421,768 | A * | 6/1995 | Fujiwara et al. | 451/283 |
| 6,390,909 | B2 * | 5/2002 | Foster et al. | 451/444 |
| 6,688,957 | B2 * | 2/2004 | Tolles | 451/532 |
| 6,702,651 | B2 * | 3/2004 | Tolles | 451/41 |
| 8,257,150 | B2 * | 9/2012 | Fujita | 451/56 |
| 2001/0041527 | A1 * | 11/2001 | Foster et al. | 451/444 |
| 2002/0164928 | A1 * | 11/2002 | Tolles | 451/41 |
| 2003/0013381 | A1 * | 1/2003 | Benner et al. | 451/21 |
| 2005/0260936 | A1 * | 11/2005 | Rodriguez et al. | 451/56 |
| 2006/0121837 | A1 * | 6/2006 | Seike | 451/56 |
| 2011/0065365 | A1 * | 3/2011 | Fukushima et al. | 451/56 |
| 2011/0312254 | A1 * | 12/2011 | Koyama | 451/56 |

FOREIGN PATENT DOCUMENTS

| | | | |
|---|---|---|---|
| JP | 59-030668 | A | 2/1984 |
| JP | U64-050051 | A | 3/1989 |
| JP | 07-009340 | A | 1/1995 |
| JP | 2001-129755 | A | 5/2001 |
| JP | 2003-145423 | A | 5/2003 |
| JP | 2004-090142 | A | 3/2004 |
| JP | 2006-218553 | A | 8/2006 |
| JP | 2007/268679 | A | 10/2007 |
| JP | 2010/069601 | A | 4/2010 |

* cited by examiner

*Primary Examiner* — Eileen P. Morgan
(74) *Attorney, Agent, or Firm* — Birch, Stewart, Kolasch & Birch, LLP

(57) ABSTRACT

The method of the present invention are capable of stabilizing a polishing rate, reducing number of times of performing dressing operations, improving work efficiency and extending a span of life of the polishing pad. The method for dressing a polishing pad, which has been used to polish a surface of a work by pressing the work onto the polishing pad fixed on a polishing plate with supplying slurry thereto, by using a grind stone, comprises the steps of: cleaning the polishing pad by supplying high-pressure cleaning water to the polishing pad; and dressing the polishing pad by moving a dressing grind stone, in the radial direction of the polishing pad, along a surface profile thereof, while performing the cleaning step.

13 Claims, 9 Drawing Sheets

METHOD AND APPARATUS FOR DRESSING POLISHING PAD

CROSS-REFERENCE TO RELATED APPLICATION

This application is based upon and claims the benefit of priority of the prior Japanese Patent Application No. P2010-140995, filed on Jun. 21, 2010, and the entire contents of which are incorporated herein by reference.

FIELD

The present invention relates to a method and an apparatus for dressing a polishing pad.

BACKGROUND

A work, e.g., semiconductor wafer, is polished by: pressing a surface of the work to be polished onto a surface of a polishing pad adhered on a polishing plate; and rotating the polishing plate with supplying slurry to the polishing pad.

After completing the polishing operation, the polishing pad includes produced dusts and slurry, so a polishing rate is lowered. Thus, high-pressure water is sprayed to the polishing pad, every time one batch of polishing operations are performed, so as to clean the polishing pad (see Japanese Laid-open Patent Publication No. 7-9340). Even if the polishing pad is cleaned every time one batch of polishing operations are performed, a surface of the polishing pad is deformed, in a wavelike fashion, with convex parts and concave parts, after about seven batches of polishing operations are performed. Therefore, flatness of the surface of the polishing pad is lowered, so a polishing rate must be lowered.

To solve the problem, for example, a work carrier is detached from a polishing apparatus and a dressing carrier is attached instead after performing about seven batches of polishing operations. Four ring-shaped flattening grind stones are respectively set in four through-holes of the dressing carrier, and polishing pads of an upper polishing plate and a lower polishing plate are ground by the flattening grind stones so as to flatten the surfaces of the polishing pads. Two of the four flattening grind stones grind the polishing pads of the lower polishing plate; the rest flattening grind stones grind the polishing pads of the upper polishing plate.

However, even if the polishing pads are cleaned, by spraying high-pressure water, after about seven batches of polishing operations are performed, convex parts and concave parts are gradually formed in the surfaces of the polishing pads while performing each batch of polishing operations. So, a polishing rate must be lowered. The polishing rate can be improved, by grinding the surfaces of the polishing pads with the flattening grind stones after seven batches of polishing operations are performed. However, the polishing rate is unstable. Thus, the polishing rate must be adjusted according to polishing time, so it is difficult to control polishing operations to polish works precisely. Further, it takes 15-20 minutes to attach the dressing carrier instead of the work carrier and dress the polishing pads after performing seven batches of polishing operations, so work efficiency must be lowered. Further, the surfaces of the polishing pads are ground, by the flattening grind stones, every time seven batches of polishing operations are performed, so spans of lives of the polishing pads must be shortened.

SUMMARY

Accordingly, it is objects to provide a method and an apparatus for dressing a polishing pad so as to solve the above described problems of the conventional technology. Namely, the method and the apparatus of the present invention are capable of stabilizing a polishing rate, reducing number of times of performing dressing operations, improving work efficiency and extending a span of life of the polishing pad.

To achieve the objects, the present invention has following structures.

Namely, the method for dressing a polishing pad, which has been used to polish a surface of a work by pressing the work onto the polishing pad fixed on a polishing plate with supplying slurry thereto, by using a grind stone, comprises the steps of:

cleaning the polishing pad by supplying high-pressure cleaning water to the polishing pad; and dressing the polishing pad by moving a dressing grind stone, in the radial direction of the polishing pad, along a surface profile thereof, while performing the cleaning step.

Preferably, the cleaning step and the dressing step are performed after one batch of polishing operations are completed.

For example, the method may further comprise the step of flattening the polishing pad, by using a flattening grind stone, after 20 batches of polishing operations are completed.

On the other hand, the apparatus for dressing a polishing pad, which has been used to polish a surface of a work by pressing the work onto the polishing pad fixed on a polishing plate with supplying slurry thereto, by using a grind stone, comprises:

a cleaning unit including a first moving member, which is capable of moving in the radial direction of the polishing pad, and a nozzle, which is provided to the first moving member and capable of spraying high-pressure cleaning water;

a dressing unit including a second moving member, which is capable of moving in the radial direction of the polishing pad, and a dressing grind stone, which is provided to the second moving member and capable of following surface profile of the polishing pad so as to dress the polishing pad; and a control unit for controlling the cleaning unit and the dressing unit so as to make the dressing unit dress the polishing pad while the cleaning unit cleans the polishing pad.

Preferably, a common moving member acts as the first moving member and the second moving member. With this structure, the apparatus can be downsized.

Further, the nozzle and the dressing grind stone may be provided on each of an upper part and a lower part of the moving member so as to simultaneously clean and dress polishing pads of an upper polishing plate and a lower polishing plate. With this structure, the polishing pads of the upper polishing plate and the lower polishing plate can be simultaneously cleaned and dressed.

In the present invention, each batch of polishing operations can be performed at a stabilized polishing rate, works can be polished precisely, number of times of dressing the polishing pad with the flattening grind stone can be reduced, work efficiency can be improved, and a span of life of the polishing pad can be extended.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
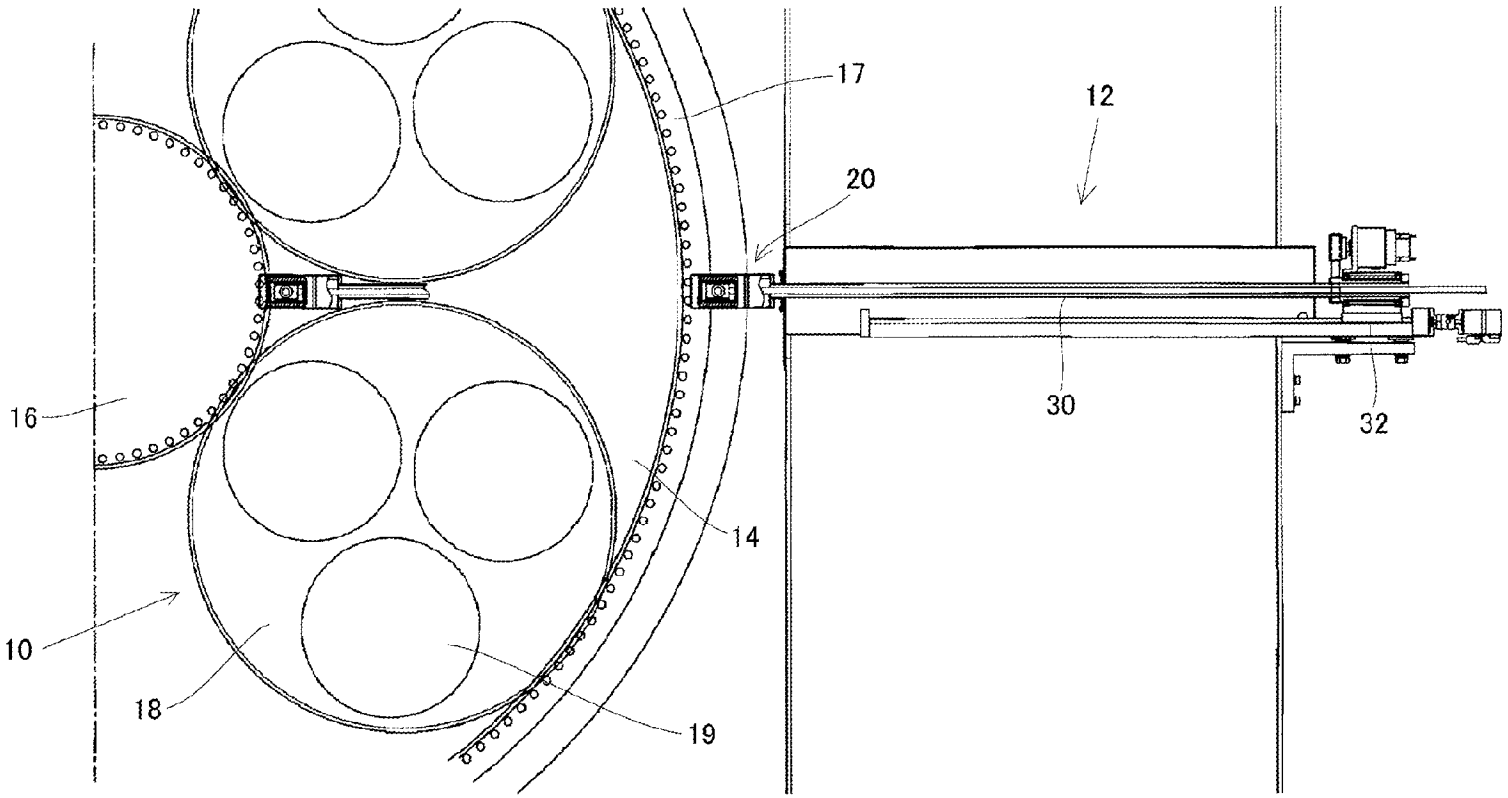
FIG. 1 is a partial plan view of a polishing apparatus and a dressing apparatus of an embodiment of the present invention.
Figure 2:
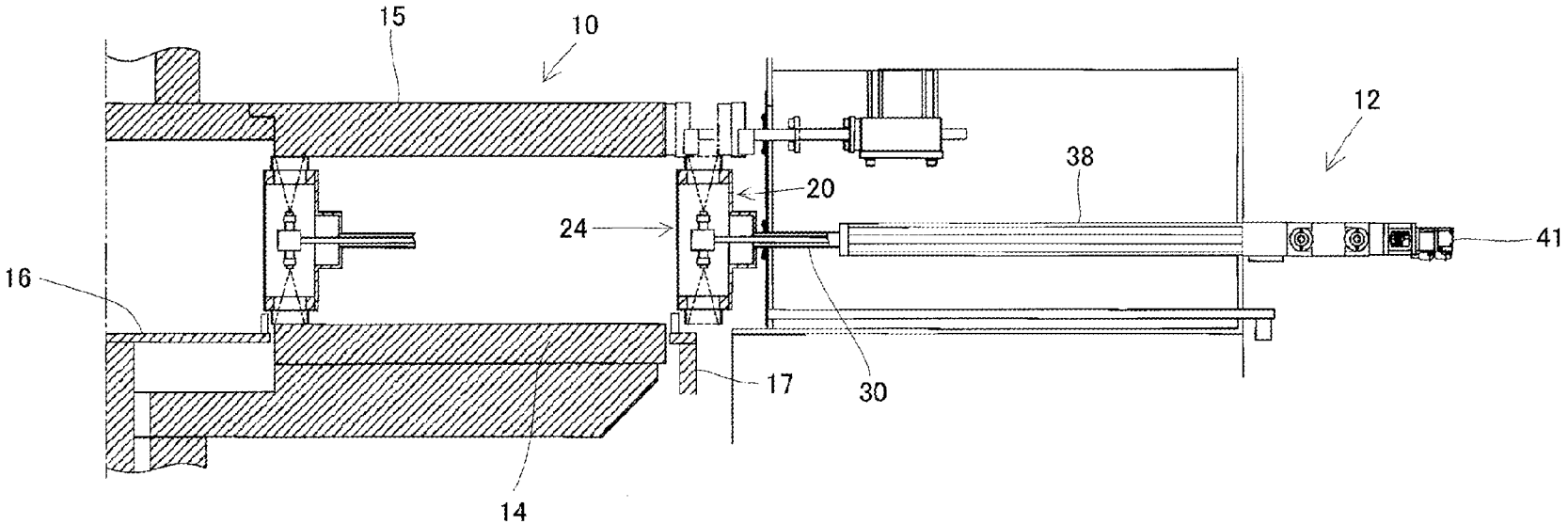
FIG. 2 is a partial plan view of the polishing apparatus and the dressing apparatus.

FIG. 1 is a partial plan view of a double-sided polishing apparatus 10 and a polishing pad dressing apparatus 12 relating to the present invention, and FIG. 2 is a partial plan view thereof.

The double-sided polishing apparatus 10 comprises: a lower polishing plate 14 having an upper surface on which a polishing pad (not shown) composed of, for example, polyurethane is adhered; an upper polishing plate 15 having a lower surface on which a polishing pad (not shown) is adhered; a sun gear 16 being constituted by pin gears; an internal gear 17 being constituted by pin gears; and carriers 18 being engaged with the sun gear 16 and the internal gear 17.

Each of the carriers 18 has through-holes 19, in each of which a work to be polished, e.g., semiconductor wafer, will be set. By rotating the sun gear 16 and the internal gear 17, the carriers 18 are moved around the sun gear 16 with spinning about its own axis. While polishing the works, the lower polishing plate 14 and the upper polishing plate 15 are rotated, in the opposite rotational directions, at the same speed.

The double-sided polishing apparatus 10 further comprises: mechanisms for rotating the lower polishing plate 14, the upper polishing plate 15, the sun gear 16 and the internal gear 17; a mechanism for moving the upper polishing plate 15 upward and downward; and a mechanism for supplying slurry to the polishing pad of the lower polishing plate 14. Note that, the mechanisms are known mechanisms, so they are not explained and shown in the drawings.

An operation for polishing the works will be explained.

The works to be polished (not shown) are respectively set in the through-holes 19 of the carriers 18. The upper polishing plate 15 is moved downward until the works are sandwiched between the lower polishing plate 14 and the upper polishing plate 15. In this state, the carriers 18 are moved around the sun gear 16 with spinning about its own axis and slurry is supplied. By rotating the lower polishing plate 14 and the upper polishing plate 15, the both surfaces of each work can be polished.

Next, a dressing apparatus 12 for dressing the polishing pads will be explained.

Figure 3:
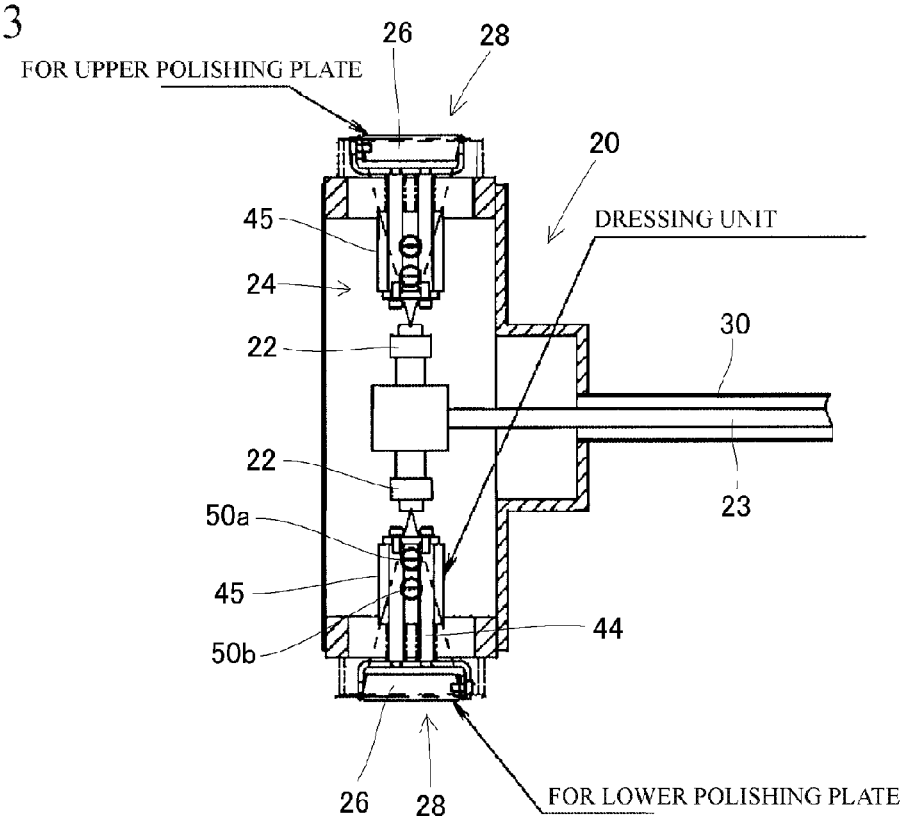
FIG. 3 is a front view of a common moving member.
Figure 4:
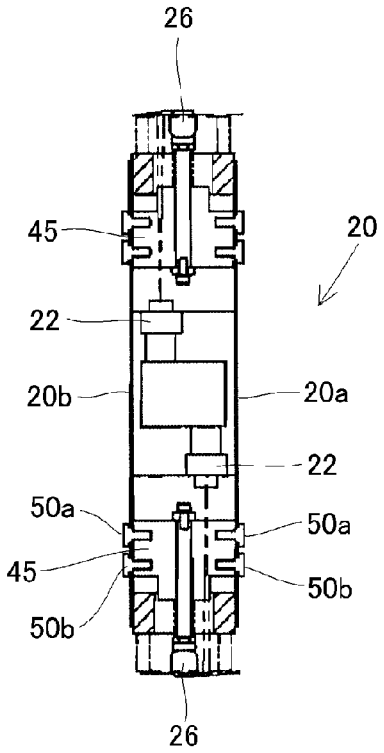
FIG. 4 is a side view of the common moving member.
Figure 10:
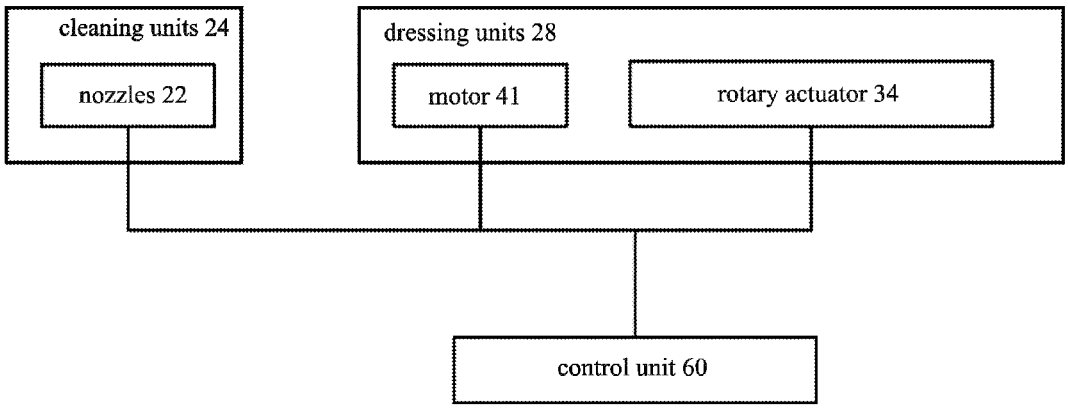
FIG. 10 is a block diagram of a control unit.

As shown in FIGS. 3 and 4, the dressing apparatus 12 comprises: cleaning units 24; dressing units 28; and a control unit 60 (FIG. 10). Each of the cleaning units 24 includes: a common moving member 20 being capable of moving in the radial direction of the polishing pad; and a nozzle 22 being provided to the common moving member 20 and capable of spraying high-pressure cleaning water toward the polishing pad. Each of the dressing units 28 includes: the common moving member 20; and a dressing grind stone 26 being provided to the common moving member 20 and capable of following a surface profile of the polishing pad so as to dress the polishing pad. The control unit 60 controls the cleaning units 24 and the dressing units 28 so as to make the dressing units 28 dress the polishing pads while the cleaning units 24 clean the polishing pads.

Figure 5:
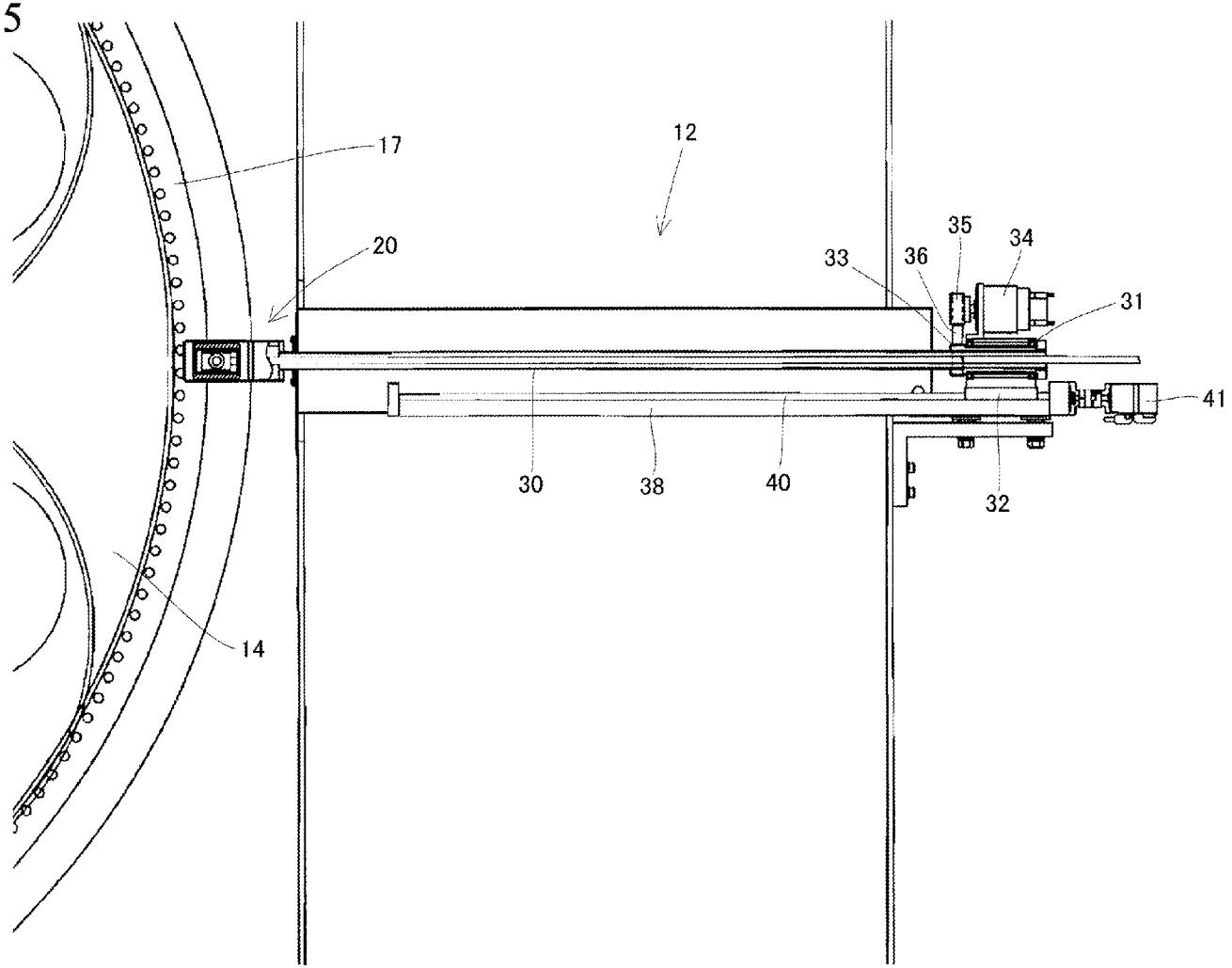
FIG. 5 is a plan view of a mechanism for linearly moving the common moving member.

As shown in FIGS. 1, 2 and 5, the common moving member 20 is fixed to a front end of a hollow shaft 30. A rear end of the hollow shaft 30 is held by a bearing 31 and rotatably attached to a travelling member 32. The hollow shaft 30 can be turned about its axial line. A timing gear 33 is fixed on the hollow shaft 30. A timing belt 36 is engaged with the timing gear 33 and a timing gear 35 provided to a rotary shaft of a rotary actuator 34. The rotary actuator 34 is driven by a pneumatic drive unit.

The hollow shaft 30 can be turned, in both rotational directions, about its axial line, in the horizontal plane, within a turning range of 90 degrees. With this structure, the common moving member 20, which is fixed to the front end of the hollow shaft 30, is also turned in the horizontal plane within a turning range of 90 degrees. The nozzles 22 and the dressing grind stones 26 are fixed to the common moving member 20. In an in-use state, the common moving member 20 including the nozzles 22 and the dressing grind stones 26 is vertically long. If the common moving member 20 is vertically long, the common moving member 20 is interfered with the pin gears of the internal gear 17 when the common moving member 20 is moved from a position outside of the polishing plates 14 and 15 to a position therebetween. To avoid the interference, the common moving member 20 is turned 90 degrees, about the axial line, together with the hollow shaft 30, so that the common moving member 20 is made horizontally long. In this state, the common moving member 20 can be moved to the position between the polishing plates 14 and 15.

As shown in FIG. 5, the travelling member 32 is capable of moving to and away from the polishing apparatus 10 along a guide rail 38. A ball screw 40 is screwed with the travelling member 32. By turning the ball screw 40 by a motor 41, the travelling member 32 is moved along the guide rail 38.

Next, the cleaning unit 24 and the dressing unit 28 will be explained with reference to FIGS. 3 and 4.

The nozzles 22 and the dressing grind stones 26 are respectively provided to an upper part and a lower part of the common moving member 20. A high-pressure hose 23 is inserted into the hollow shaft 30 and connected to the nozzles 22. High-pressure water, e.g., pressure of 3-15 MPa, can be sprayed from the nozzles 22. In the present embodiment, an upper nozzle and a lower nozzle are employed, but number of the nozzles is not limited. Further, brushes (not shown) which are capable of preventing the high-pressure water from splashing may be provided around the nozzles 22.

Preferably, the nozzles 22 and the dressing grind stones 26 are suitably arranged in the common moving member 20 so as to perform the dressing operation of the polishing pads before performing the cleaning operation of the polishing pads.

Figure 6:
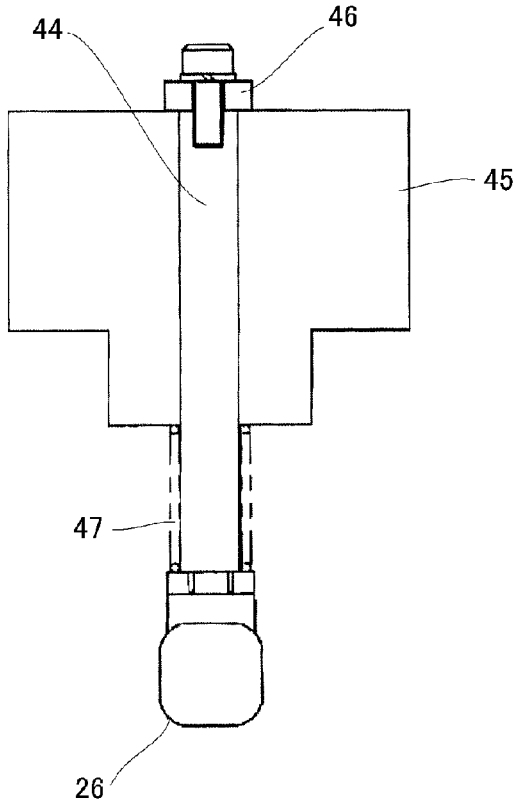
FIG. 6 is a side view of a supporting section of a dressing grind stone.
Figure 7:
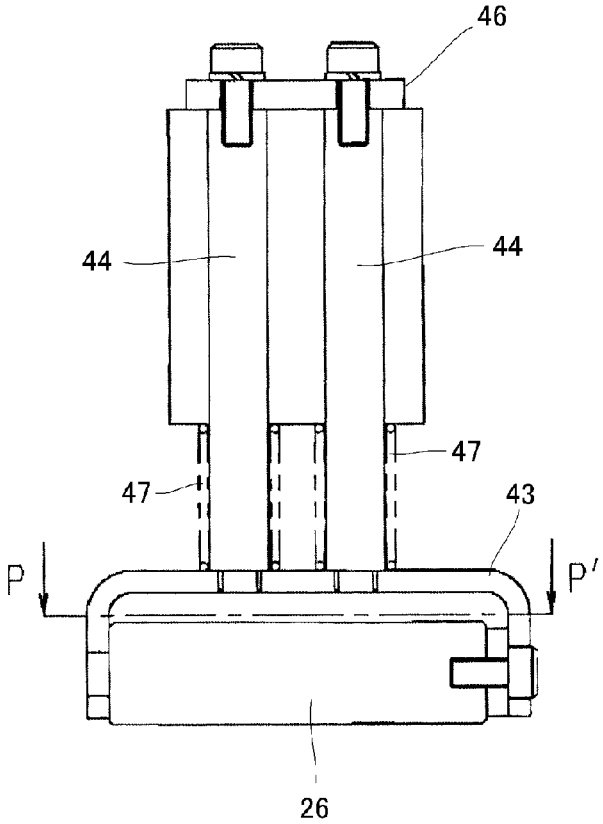
FIG. 7 is a front view of the supporting section of the dressing grind stone.

In the present embodiment, as shown in FIGS. 6 and 7, the dressing grind stone 26 is formed into a square pole having a rectangular sectional shape, and four side surfaces of the dressing grind stone 26 can be used as grinding surfaces. Diamond abrasive grains are electrodeposited on the grinding surfaces.

Ends of the dressing grind stone 26 are connected to a U-shaped holder 43 (see FIG. 7) by screws. By changing connection ends with respect to the holder 43, the side surfaces of the dressing grind stone 26 can be sequentially used as the grinding surfaces.

Note that, in the present embodiment, boundaries between the surfaces of the dressing grind stone 26 formed into the square pole are rounded so as not to engage with the polishing pad, but the shape of the dressing grind stone 26 is not limited to the present embodiment.

Two supporting rods 44 are fixed to the holder 43. The supporting rods 44 are pierced through a supporting base 45, and ends of the supporting rods 44 are projected therefrom. A stopper plate 46 is fixed to the projected ends of the supporting rods 44 by screws. Coil springs 47, which respectively cover the supporting rods 44, are provided between the holder 43 and the supporting base 45. With this structure, the dressing grind stone 26 is always biased to move away from the supporting base 45.

As shown in FIGS. 3 and 4, each of the supporting bases 45 is provided in the common moving member 20 in a state where the dressing grind stone 26, which is formed into the square pole, is parallel to the hollow shaft 30.

Each of the supporting bases 45 is attached to side wall plates 20*a* and 20*b* of the common moving member 20, and each side of the supporting base 45 is connected to each of the side wall plates 20*a* and 20*b* by two screws 50*a* and 50*b*. The supporting base 45 is inclinable, within a prescribed range, in a direction parallel to the paper surface of the drawing of FIG. 3, i.e., a direction parallel to a longitudinal direction of the dressing grind stone 26 formed into the square pole. With this structure, the dressing grind stone 26 formed into the square pole, whose length is several cm, can incline to follow a surface profile of the polishing pad, i.e., convex parts, concave parts.

Note that, through-holes (not shown) of the side wall plates 20*a* and 20*b*, through which the screws 50*a* respectively pass, are long through-hole, so that the inclinable range of the supporting base 45 is defined by the long through-holes.

The structure of the dressing apparatus 12 has been explained above. Next, the dressing step performed by the dressing apparatus 12 will be explained.

Upon completing the polishing operation, the upper polishing plate 15 is moved upward, and the polished works are taken out from the carriers 18. The carriers 18 need not be taken out from the polishing apparatus 10.

Next, the hollow shaft 30 is turned by driving the rotary actuator 34 so as to make the common moving member 20 horizontally long.

Then, the motor 41 is driven so as to move the travelling member 32, along the guide rail 38, until reaching the position between the polishing plates 14 and 15.

At that time, the common moving member 20 is horizontally long, so it can smoothly move into the position between the polishing plates 14 and 15. Note that, the common moving member 20 is moved, on the polishing pad, through a space between the carriers 18 (see FIG. 1). Namely, positions of the carriers 18 are adjusted to the shown positions after completing the polishing operation.

Next, the hollow shaft 30 is turned to the initial state by driving the rotary actuator 34 so as to make the common moving member vertically long.

Next, the upper polishing plate 15 is moved downward so as to press the polishing pads of the polishing plates 14 and 15 onto the dressing grind stones 26.

The dressing grind stones 26 are biased, by the coil springs 47, to project from the supporting base 45. By pressing the polishing pads of the polishing plates 14 and 15 onto the dressing grind stones 26, the dressing grind stones 26 are moved inward, against the elasticity of the coil springs 47, so that the supporting rods 44 are pressed into the supporting bases 45. With this action, the dressing grind stones 26 are always biased, by the compressed coil springs 47, and contact the polishing pads with constant force.

In this state, the dressing step is started.

The control unit 60 controls each of the units and mechanisms so as to spray high-pressure water toward the polishing pads from the nozzles 22, rotate the polishing plates 14 and 15 in the opposite directions and drive the motor 41 to move the hollow shaft 30. With this control, the dressing grind stones 26 are moved, on the polishing pads, in the radial direction of the polishing pads, and then the cleaning operation and the dressing operation of the polishing pads are simultaneously performed. Since the dressing grind stones 26 are inclinable with respect to the common moving member 20, the dressing grind stones 26 are capable of following the surface profiles of the polishing pads.

The polishing pads are dressed, by the dressing grind stones 26, on the upstream side, and high-pressure water is sprayed toward the dressed polishing pads on the downstream side. Therefore, the cleaning operation and the dressing operation of the polishing pads can be simultaneously performed.

Preferably, the common moving member 20 is reciprocally moved, on the polishing pads, several times, so as to uniformly clean and dress the entire surfaces of the polishing pads.

The length of the dressing grind stones 26 is several cm, and the dressing grind stones 26 are moved in the radial directions of the polishing pads with following the surface profiles thereof. Unlike ring-shaped flattening grind stones, the dressing grind stones 26 contact and grind the entire surfaces of the polishing pads, but they do not flatten convex parts and concave parts of the polishing pads.

The dressing grind stones 26 are moved, with following the surface profiles of the polishing pads, so as to dress the surfaces of the polishing pads (i.e., slightly grinding the surfaces to restore the surfaces).

Next, the polishing pads are dressed by the flattening grind stone, after a plurality of batches of polishing operations (for example, 20 batches) are completed.

Figure 8:
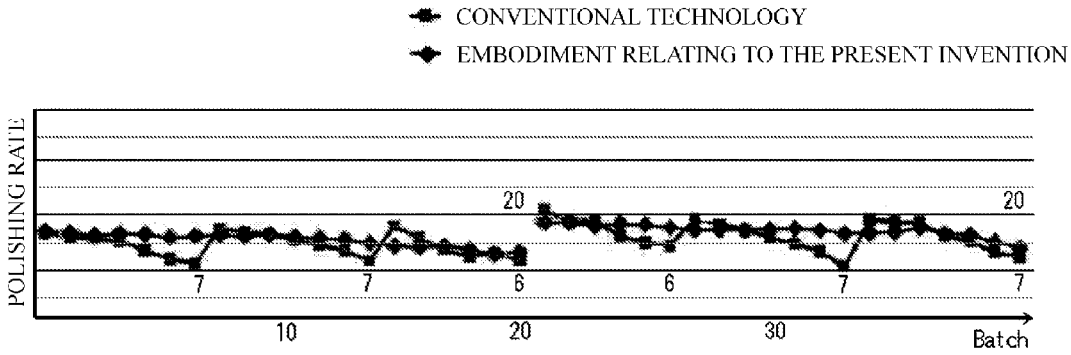
FIG. 8 is a graph showing a polishing rate of a polishing pad dressed by the dressing apparatus of the embodiment and that of a polishing pad dressed by a conventional apparatus.

FIG. 8 is a graph showing a polishing rate of a polishing pad dressed by the dressing apparatus of the present embodiment and that of a polishing pad dressed by a conventional apparatus. The conventional apparatus performed only the cleaning operation every time one batch of polishing operations were completed. As shown in FIG. 8, the polishing rate was significantly lowered after seven batches of polishing operations were completed. Therefore, in the conventional apparatus, polishing time is gradually extended to secure an amount of polishing the work, and the carrier is detached and replaced with dress carrier after seven batches of polishing operations are performed. Then, a surface of a polishing pad must be flattened by a flattening grind stone.

On the other hand, in the dressing apparatus of the present embodiment, the cleaning step and the dressing step were performed every time one batch of polishing operations were completed. Therefore, as clearly shown in FIG. 8, the polishing rate was not significantly lowered after completing one batch of polishing operations, so a fixed polishing rate was maintained. Flattening the polishing pad was required after 20 batches of polishing operations were completed. Generally, it takes a long time to flatten the polishing pad. Therefore, the present invention can reduce number of times of flattening the polishing pad and improve polishing efficiency. The polishing rate vary slightly, so that an amount of polishing a work can be easily controlled and the work can be precisely polished. Further, number of times of flattening the polishing pad can be reduced, so that a span of life of the polishing pad can be extended.

Figure 9:
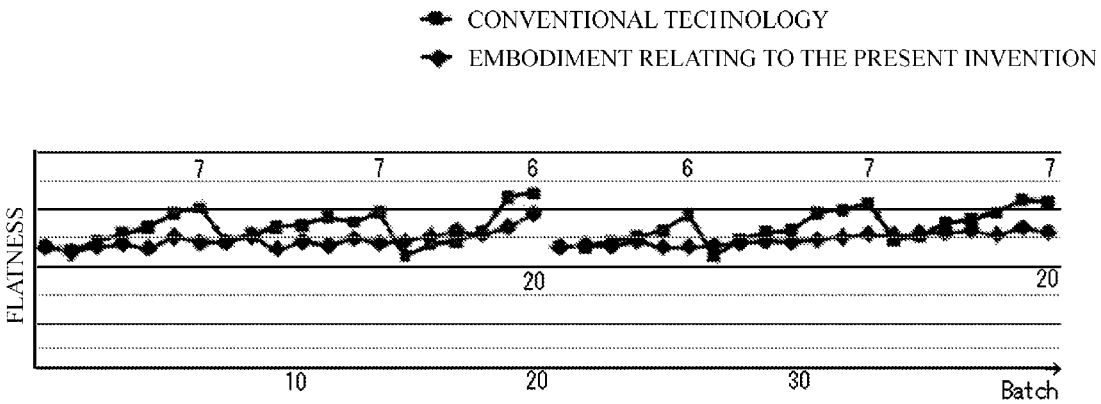
FIG. 9 is a graph showing flatness of the work polished by the polishing pad dressed by of the dressing apparatus of the embodiment and that of the work polished by the polishing pad dressed by the conventional apparatus.

FIG. 9 is a graph showing flatness of the work polished by the polishing pad dressed by the dressing apparatus of the present embodiment and that of the work polished by the polishing pad dressed by the conventional apparatus. As shown in FIG. 9, in case of using the conventional apparatus, flatness of the work drastically varied. On the other hand, in case of using the dressing apparatus of the present embodiment, flatness was uniformly maintained, so quality of the work could be stabilized. Condition of the polishing pad was stably maintained, as shown in FIG. 8, so that the effects could be obtained by the apparatus of the present embodiment.

Figure 11:
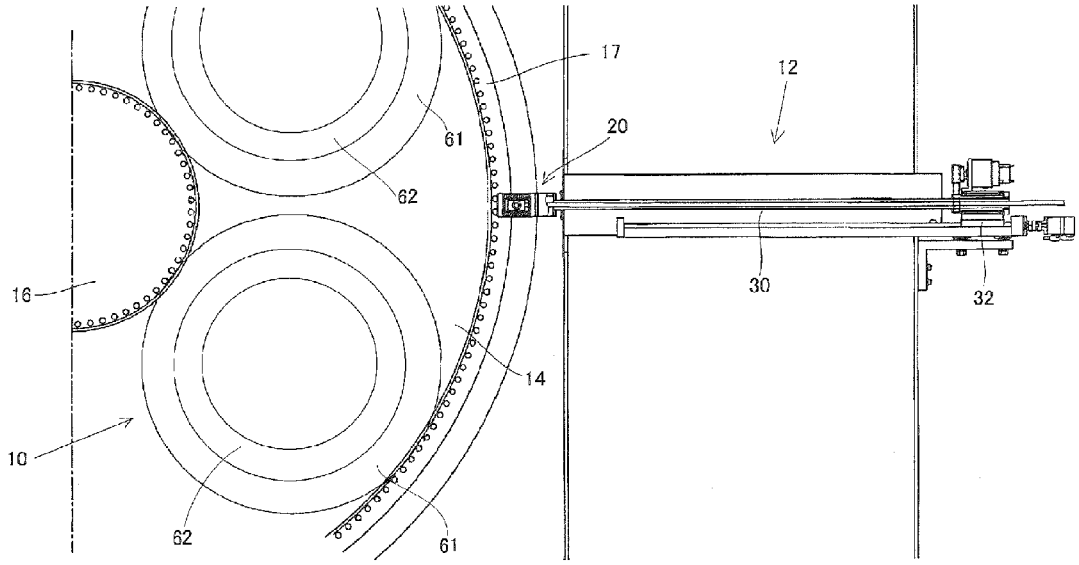
FIG. 11 is an explanation view of a step of flattening polishing pads, in which dressing carriers are used instead of carriers and the polishing pads are flattened by flattening grind stones.

FIG. 11 shows a step of flattening the polishing pads. In the flattening step, the carriers 18 are detached from the polishing apparatus 10, and dressing carriers 61 are attached instead of the carriers 18. Ring-shaped flattening grind stones 62 are respectively set in through-holes of the dressing carriers 61. The polishing pads of the upper and lower polishing plates 14 and 15 are ground and flattened by the ring-shaped flattening grind stones 62. The flattening step may be performed after about 20 batches of polishing operations are completed.

In the above described embodiment, the cleaning unit 24 and the dressing unit 28 are provided to the common moving member 20, but the cleaning unit 24 may be provided to a first moving member and the dressing unit 28 may be provided to a second moving member separated from the first moving member. In case of employing the first and second moving members too, the cleaning operation and the dressing operation are simultaneously performed.

In the above described embodiment, the polishing apparatus is the double-sided polishing apparatus, but the dressing apparatus of the present invention may be applied to a one-sided polishing apparatus. In case of applying to a one-sided polishing apparatus, a work is held on a bottom face of a work holding head and pressed onto a polishing pad of a lower polishing plate so as to polish a lower surface of the work. After completing the polishing operation, the surface of the polishing pad is simultaneously cleaned and dressed by the dressing apparatus of the present invention. In this case, no upper polishing plate exists, so the dressing unit must be pressed onto the lower polishing plate by a suitable press mechanism (not shown).

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A method for dressing pads of a work polishing apparatus, which includes an upper polishing plate having a lower face, on which the polishing pad is fixed, and a lower polishing plate having an upper face, on which the polishing pad is fixed, and in which a work is sandwiched between the polishing pads of the both rotating polishing plates and polished with supplying slurry to the polishing pads, by using a dressing grind stone, after polishing the work;

said method being performed in a dressing apparatus, comprising:

a moving member, which is capable of reciprocally moving in a space between the both polishing plates and in the radial direction of the polishing pads;

a driving unit for reciprocally moving the moving member in the radial direction of the polishing pads;

a cleaning unit including nozzels, which are respectively provided to an upper side and a lower side of the moving member and capable of respectively spraying high-pressure cleaning water toward the polishing pads of the upper polishing plate and the lower polishing plate;

a dressing unit including the dressing grind stones, which are respectively provided to the upper side and the lower side of the moving member, respectively biased toward and pressed onto the polishing pads of the upper polishing plate and the lower polishing plate by biasing members, capable of inclining in the radial direction of the polishing pads and capable of inclining and following surface profiles of the polishing pads, with the movement of the moving member in the radial direction of the polishing pads, so as to dress the polishing pads; and a control unit for controlling actions of the driving unit and the cleaning unit so as to make the dressing unit dress the polishing pads while the cleaning unit cleans the polishing pads, said method comprising the steps of:

rotating the upper polishing plate and the lower polishing plate and moving the moving member reciprocally in the radial direction of the polishing pads after polishing the work; and simultaneously dressing the polishing pads of the upper polishing plate and the lower polishing plate by moving the dressing grind stones in the radial direction of the polishing pads with inclining and following the surface profiles of the polishing pads, and simultaneously cleaning the polishing pads of the upper polishing plate and the lower polishing plate by supplying the high-pressure cleaning water from the nozzles to the polishing pads.

2. The method according to claim 1, wherein, in the moving step, cleaning and dressing the polishing pads are performed after one batch of work polishing operations are completed.

3. The method according to claim 2, further comprising the additional step of flattening the polishing pad, by using a seperate ring-shaped flattening grind stone, after a plurality of batches of polishing, cleaning and dressing operations are completed.

4. The method according to claim 1, wherein the dressing grind stone is a grind stone formed into a pole-shaped member having a rectangular sectional shape, and surfaces of the dressing grind stone are sequentially used as grinding surfaces.

5. The method according to claim 1, wherein dressing the polishing pad is performed before the cleaning step.

6. The method according to claim 4, wherein the pole-shaped dressing grind stone is capable of inclining in a direction parallel to an extending direction of the pole-shaped dressing grind stone.

7. A dressing apparatus for dressing polishing pads of a work polishing apparatus, the work polishing apparatus including an upper polishing plate having a lower face, on which the polishing pad is fixed, and a lower polishing plate having an upper face, on which the polishing pad is fixed, and in which a work is sandwiched between the polishing pads of the both rotating polishing plates and polished with supplying slurry to the polishing pads, by using a dressing grind stone, after polishing the work;

the dressing apparatus, comprising:

a moving member, which is capable of reciprocally moving in a space between the both polishing plates and in the radial direction of the polishing pads;

a driving unit for reciprocally moving the moving member in the radial direction of the polishing pads;

a cleaning unit including nozzels, which are respectively provided to an upper side and a lower side of the moving member and capable of respectively spraying high-pressure cleaning water toward the polishing pads of the upper polishing plate and the lower polishing plate;

a dressing unit including dressing grind stones, which are respectively provided to the upper side and the lower side of the moving member, respectively biased toward and pressed onto the polishing pads of the upper polishing plate and the lower polishing plate by biasing members, capable of inclining in the radial direction of the polishing pads, and capable of inclining and following surface profiles of the polishing pads, with the movement of the moving member in the radial direction of the polishing pads, so as to dress the polishing pads; and a control unit for controlling actions of the driving unit and the cleaning unit so as to make the dressing unit dress the polishing pads while the cleaning unit cleans the polishing pads.

8. The dressing apparatus according to claim 7, wherein the nozzle and the dressing grind stone are arranged in the moving member so as to dress the polishing pad before cleaning the polishing pad.

9. The dressing apparatus according to claim 7, wherein the dressing grind stone is a grind stone formed into a pole-shaped member having a rectangular sectional shape, and surfaces of the dressing grind stone are sequentially used as grinding surfaces.

10. The dressing apparatus according to claim 7, wherein the moving member is capable of turning within a range of 90 degrees, with respect to the horizontal plane.

11. The dressing apparatus according to claim 9, wherein the pole-shaped dressing grind stone is capable of inclining in a direction parallel to an extending direction of the pole-shaped dressing grind stone.

12. The dressing apparatus according to claim 7, wherein the driving unit comprises:

a shaft having a front end, to which the moving member is fixed, and a rear end;

a travelling member, to which the rear end of the shaft is fixed;

a guide rail for guiding movement of the travelling member, which is moved to and away from the work polishing apparatus; and a ball bearing screw mechanism for moving the travelling member along the guide rail.

13. The dressing apparatus according to claim 12, wherein the shaft is a hollow shaft, and a hose for supplying the high-pressure water to the nozzles is provided in the hollow shaft.

* * * * *